US008746875B2

(12) United States Patent
Uchida et al.

(10) Patent No.: US 8,746,875 B2
(45) **Date of Patent: *Jun. 10, 2014**

(54) PRINTER

(71) Applicant: Canon Kabushiki Kaisha, Tokyo (JP)

(72) Inventors: Haruo Uchida, Yokohama (JP); Yasuhiko Ikeda, Sagamihara (JP); Hiroyuki Saito, Yokohama (JP); Kenji Shigeno, Yokohama (JP); Koichiro Kawaguchi, Yokohama (JP); Takaaki Ishida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/890,639

(22) Filed: May 9, 2013

(65) Prior Publication Data

US 2013/0242020 A1 Sep. 19, 2013

Related U.S. Application Data

(62) Division of application No. 12/675,275, filed as application No. PCT/JP2009/058797 on Apr. 30, 2009, now Pat. No. 8,469,506.

(30) Foreign Application Priority Data

| | | |
|---|---|---|
| May 8, 2008 | (JP) | 2008-122402 |
| Aug. 25, 2008 | (JP) | 2008-215278 |
| Mar. 30, 2009 | (JP) | 2009-082230 |

(51) Int. Cl.

| | |
|---|---|
| ***B41J 2/01*** | (2006.01) |
| ***B41J 29/13*** | (2006.01) |
| ***B41J 29/02*** | (2006.01) |
| *B41J 11/02* | (2006.01) |

(52) U.S. Cl.
CPC *B41J 29/02* (2013.01); *B41J 29/13* (2013.01); *B41J 11/02* (2013.01)
USPC ..... 347/104; 347/101; 347/108

(58) Field of Classification Search
None
See application file for complete search history.

(56) References Cited

U.S. PATENT DOCUMENTS

| | | | | |
|---|---|---|---|---|
| 4,802,780 | A * | 2/1989 | Yokoi | 400/643 |
| 4,846,595 | A * | 7/1989 | Kato et al. | 400/320 |

(Continued)

FOREIGN PATENT DOCUMENTS

| | | | |
|---|---|---|---|
| JP | 03010867 | A * | 1/1991 |
| JP | 03-266678 | A | 11/1991 |

(Continued)

OTHER PUBLICATIONS

International Preliminary Report on Patentability issued in International Application No. PCT/JP2009/058797.

*Primary Examiner* — Laura Martin
*Assistant Examiner* — Leonard S Liang
(74) *Attorney, Agent, or Firm* — Fitzpatrick, Cella, Harper & Scinto

(57) ABSTRACT

A printer has a base, first and second side members placed on opposite side portions of a base with respect to a first direction, at least one roller for transporting a sheet in a second direction intersecting the first direction, a print unit and a platen, the roller, the print unit and the platen being held with the first side member and the second side member. The first side member and the second side member are formed by a molded first resin material and the base is formed by a molded second resin material, and a bending elastic modulus of the first resin material is larger than that of the second resin material.

12 Claims, 20 Drawing Sheets

(56) References Cited

U.S. PATENT DOCUMENTS

| | | | | |
|---|---|---|---|---|
| 5,061,099 | A * | 10/1991 | Iwatani et al. | 400/625 |
| 5,154,411 | A | 10/1992 | Saito et al. | |
| 5,366,306 | A | 11/1994 | Mizutani et al. | |
| 5,456,544 | A | 10/1995 | Aoki et al. | |
| 5,580,042 | A | 12/1996 | Taniguro et al. | |
| 5,672,019 | A | 9/1997 | Hiramatsu et al. | |
| 5,673,074 | A | 9/1997 | Miyauchi et al. | |
| 5,725,319 | A | 3/1998 | Saito et al. | |
| 5,742,318 | A | 4/1998 | Miyauchi et al. | |
| 5,918,873 | A | 7/1999 | Saito et al. | |
| 5,982,400 | A | 11/1999 | Yokoi et al. | |
| 6,170,817 | B1 | 1/2001 | Kawaguchi | |
| 6,305,682 | B1 | 10/2001 | Saito et al. | |
| 6,318,855 | B1 | 11/2001 | Kawaguchi | |
| 6,450,710 | B1 | 9/2002 | Foster et al. | |
| 6,634,819 | B2 | 10/2003 | Uchida | |
| 6,871,949 | B2 | 3/2005 | Nakano et al. | |
| 6,910,757 | B2 | 6/2005 | Kanamitsu et al. | |
| 7,081,911 | B2 | 7/2006 | Sawai | |
| 7,204,577 | B2 | 4/2007 | Kanamitsu et al. | |
| 7,494,214 | B2 | 2/2009 | Nitta et al. | |
| 7,538,786 | B2 * | 5/2009 | Hirai | 347/220 |
| 7,607,663 | B2 | 10/2009 | Sugiyama | |
| 7,641,408 | B2 | 1/2010 | Niikura et al. | |
| 8,240,842 | B2 * | 8/2012 | Ito et al. | 347/104 |
| 8,469,506 | B2 * | 6/2013 | Uchida et al. | 347/104 |
| 2001/0028810 | A1 * | 10/2001 | Yamaguchi et al. | 399/110 |
| 2002/0085239 | A1 | 7/2002 | Niikura | |
| 2002/0118266 | A1 | 8/2002 | Yamaguchi et al. | |
| 2003/0035039 | A1 | 2/2003 | Kanome et al. | |
| 2004/0017462 | A1 | 1/2004 | Takahashi et al. | |
| 2004/0141041 | A1 | 7/2004 | Tsutsumi et al. | |
| 2004/0155923 | A1 | 8/2004 | Ikeda et al. | |
| 2004/0179045 | A1 | 9/2004 | Awai et al. | |
| 2005/0012800 | A1 | 1/2005 | Ohashi | |
| 2005/0017441 | A1 * | 1/2005 | Sugiyama | 271/264 |
| 2005/0275705 | A1 | 12/2005 | Nitta et al. | |
| 2006/0024118 | A1 | 2/2006 | Niikura et al. | |
| 2006/0170749 | A1 * | 8/2006 | Watanabe | 347/104 |
| 2007/0081199 | A1 * | 4/2007 | Koga et al. | 358/450 |
| 2009/0152801 | A1 | 6/2009 | Shigeno | |
| 2009/0322819 | A1 | 12/2009 | Hayashi et al. | |

FOREIGN PATENT DOCUMENTS

| | | | |
|---|---|---|---|
| JP | 05-000556 | | 1/1993 |
| JP | 07-186489 | | 7/1995 |
| JP | 2001-253126 | A | 9/2001 |
| JP | 2002-248819 | | 9/2002 |
| JP | 2003-072111 | | 3/2003 |
| JP | 2003326804 | A * | 11/2003 |
| JP | 2004-106375 | A | 4/2004 |
| JP | 2005-169793 | | 6/2005 |
| JP | 2005-349779 | A | 12/2005 |
| JP | 2006-212797 | A | 8/2006 |
| JP | 2007-119172 | A | 5/2007 |

* cited by examiner

PRINTER

This application is a divisional of U.S. patent application Ser. No. 12/675,275, filed Feb. 25, 2010, and allowed on Mar. 25, 2013.

TECHNICAL FIELD

The present invention relates to a printer which forms an image on a sheet with a printing head.

BACKGROUND ART

The construction of a main body of a conventional ink jet printer will be described. For conventional printers, a divided chassis construction using a metalwork material has been adopted. On chassis members in the divided chassis construction, constituent members relating to recording are positioned and held.

The construction of a printer disclosed in U.S. Patent Publication No. 2006/0024118 will be described by way of example with reference to FIG. 23. A multiple feed unit section (not shown) 10 having a plurality of feed sections and a both-side transport section is fixed in a state of being interposed between a right chassis 112 and a left chassis 113. The right chassis 112 and the left chassis 113 are formed of a metalwork material or the like having a certain strength. A main chassis 11 formed of a metalwork material is provided on the front sides of the right chassis 112 and the left chassis 113. A transport section unit including a transport roller, a pinch roller and a platen and a printing section unit including a carriage and a printing head, which units are not shown in the figure, are fixed on the main chassis 11. The main chassis 11 has side plate portions 11A and 11B constructed by bending a sheet metal. A stay member (platen chassis) 114 and a stay member (front chassis) 115 are connected between the side plate portions 11A and 11B to improve the rigidity.

With respect to printers such as personal printers, there is an increasing demand for further reducing the size and cost of the apparatus. Also, with the improvement in image quality in photographic printing, a demand for improving the accuracy in recording performance is increasing. In some cases, under circumstances where such demands are increasing, problems described below have arisen with the above-described conventional example.

On the left side plate portion 11B of the main chassis 11, a carriage shaft on which the carriage not shown in the figure is held and members of a transport system such as a transport roller and a platen are positioned and held. Since the component parts in the printing section system and the component parts in the transport system are positioned on the same left side plate portion 11B, the component parts can be mutually positioned with good accuracy. However, since positioning portions are formed on one bent portion, there is a need to form a sheet metal bending position in correspondence with the position of the component part requiring the largest of the widths of the mutual positions necessary in the widthwise direction. In some cases, therefore, the component parts in the printing section system and the component parts in the transport system cannot be disposed at the optimum positions in the widthwise direction, and it is difficult to pursue a further reduction in size in the widthwise direction and a reduction in cost in component part cost-cutting by reducing the width.

Also, in some cases, the transport roller and a discharge roller are adjusted in length to the carriage shaft and therefore have such an increased length that the influence of a deterioration in transport accuracy due to flexures of the shaft of the rollers is large. On the right side plate portions 11A (two places) of the main chassis 11, the carriage shaft and the members in the transport system including the transport roller and the platen, not shown in the figure, are positioned and held on separate side plates. Therefore errors in position accuracy of the recording system component parts and the transport system component parts are increased due to an error in sheet metal bending accuracy, resulting in a deterioration in recording accuracy and, in some cases, failure to perform construction with high-accuracy positioning.

On the right chassis 112 and the left chassis 113 on which the multiple feed unit section 10 having the plurality of feed sections and the both-side transport section is positioned, a feed roller and a both-side transport roller, not shown in the figure, and other components are positioned and held for the sheet maximum width. Therefore the right chassis 112 and the left chassis 113 are constructed so as to be different in position in the widthwise direction from the side plate portion 11B. Consequently, it is necessary to form the left chassis 113 and the side plate portion 11B as separate component parts. In some cases, an increase in cost and a reduction in space efficiency result from the increase in number of component parts. As a solution to this problem, forming the left chassis 113 and the left side plate portion 11B from an integral sheet metal is conceivable. In forming the left chassis 113 and the left side plate portion 11B in such a way, however, bending is required in two places because of the difference in position in the widthwise direction and a problem newly arises that the position accuracy of the component parts is reduced by bending.

Since sheet metals are used for the purpose of increasing the rigidity, rotatable or movable parts including transport system component parts such as the transport roller, pinch rollers urged against transport system component parts to produce transport force, a movable sheet guide flapper and the like cannot be directly held by the sheet metals. That is, the rotatable or movable parts are fixed on sheet metal chassis by means of slide members such as bearings formed of a resin material. An increase in the number of component parts results from this and a problem may arise that an increase in cost and a reduction in space efficiency make impossible the pursuit of a further reduction in size. Moreover, in some cases, forming all the chassis portions constituting the main body frame from sheet metals inhibits a reduction in cost and a reduction in weight of the main body.

DISCLOSURE OF THE INVENTION

A main object of the present invention is to further improve the conventional printer. A further object of the present invention is to provide a compact lightweight printer having its cost limited and capable of performing recording with high accuracy.

A printer in one form according to the present invention has a base placed at the bottom of an apparatus main body; a pair of side members disposed on opposite sides of the base with respect to a first direction; at least one roller for transporting a sheet; a carriage chassis on which a carriage which moves reciprocally in the first direction while having a printing head mounted thereon is held; a feed unit which separates and transports sheets one after another in a second direction intersecting the first direction, a platen which supports the sheet in a printing section in which recording is performed with the printing head; and wherein the pair of side members are formed by molding a resin material, and the roller, the carriage chassis, the platen and the feed unit are positioned and held with the pair of side members.

Further objects and modes of the present invention will become apparent in the following description of embodiments thereof.

Further, in some case, because the discharge roller and the platen are positioned by being fitted to the chassis, the back tension applied to the sheet varies due to small fluctuations of the platen and the discharge roller during sheet transport, resulting in a deterioration in paper feed accuracy. Also, if the above-described fitting positioning is employed, because positioning errors are added to the amounts of variation in height of the discharge roller and the platen, there is an anxiety about a deterioration in paper feed accuracy due to variation in the back tension and a deterioration in paper feed accuracy when the sheet leading end runs onto the nip line between the discharge roller and spurs.

Further features of the present invention will become apparent from the following description of exemplary embodiments with reference to the attached drawings.

BEST MODE FOR CARRYING OUT THE INVENTION

First Embodiment

Figure 1:
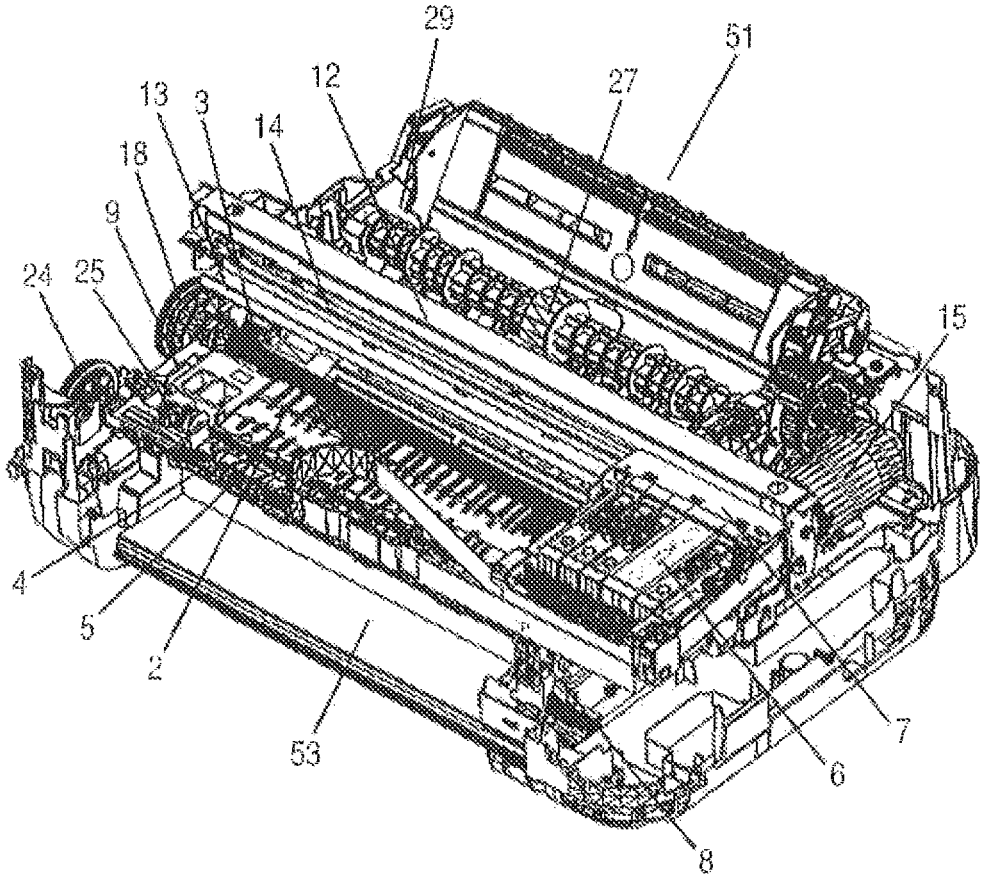
FIG. 1 is a perspective view of a main body of a printer in a first embodiment of the present invention.
Figure 2:
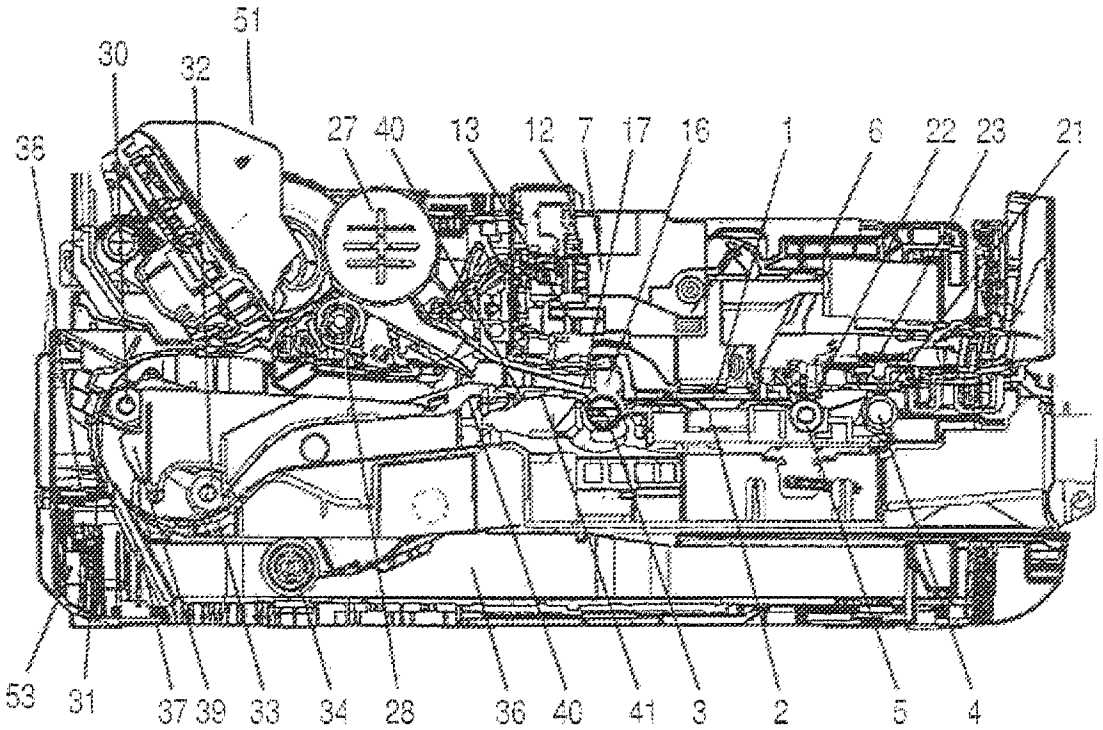
FIG. 2 is a sectional view of the main body of the printer.
Figure 3:
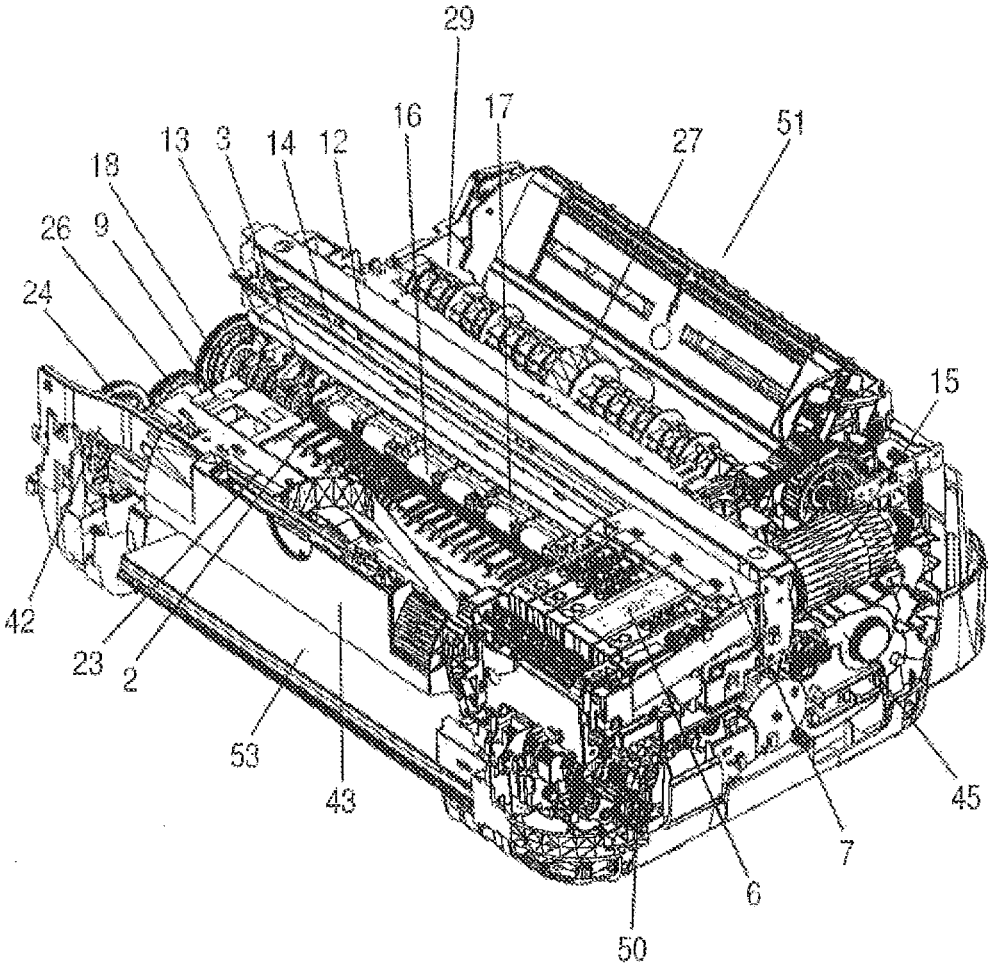
FIG. 3 is a right perspective view of the entire main body of the printer.
Figure 4:
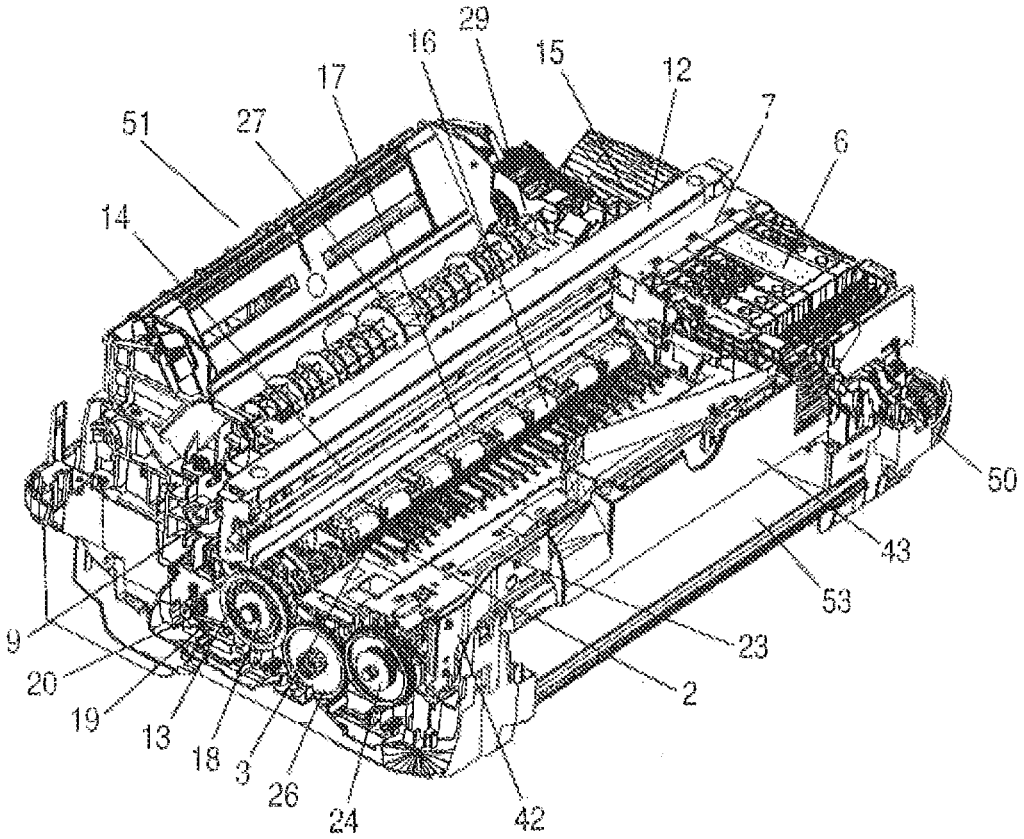
FIG. 4 is a left perspective view of the entire main body of the printer.

A first embodiment of the present invention will be described with reference to FIGS. 1, 2, 3, 4, 5, 6, 7, 8, 9, 10 and 11. The entire construction of the main body of an apparatus in the first embodiment will be described with reference to FIGS. 1, 2, 3 and 4. FIG. 1 is a perspective view illustrating constituent sections in the first embodiment. FIG. 2 is a sectional view of the main body. FIGS. 3 and 4 are perspective view illustrating the entire main body.

Sheets are stacked in a feed unit 51, separated and fed one after another by a nip between a feed roller 27 and a separating roller 28 and transported to a transport roller 3. The transport roller 3 is disposed on the upstream side of a printing head 1 in the sheet transport direction to transport sheets to a printing section. A pinch roller 16 is urged against the transport roller 3 by spring members to apply a transport force to the recording sheet while rotating in a following manner. The pinch roller 16 is held on a pinch roller holder 17. The sheet is transported to the nip between the transport roller 3 and the pinch roller 16 by being guided by sheet guide portions of the pinch roller holder 17, a transport roller sheet guide 40 and a sheet guide flapper 41. The sheet is further transported, positioned and supported on a platen 2 in the printing section, and transported to a second discharge roller 5 and a first discharge roller 4. The second discharge roller 5 and the first discharge roller 4 are disposed on the downstream side of the printing head 1 in the sheet transport direction to transport and discharge the sheet during recording. A second follower roller (spurs) 22 is urged against the second discharge roller 5 to apply a transport force while rotating in a following manner. Similarly, a first follower roller (spurs) 21 is urged against the first discharge roller 4 to apply a transport force while rotating in a following manner. The first follower roller 21 and the second follower roller 22 are held in a pinch roller holder 23.

The construction of a carriage unit in the printing section on which the printing head 1 is mounted will next be described. The carriage section reciprocates for main scanning and has a carriage 7 which moves reciprocally in a main scanning direction (a first direction) while having an inkjet printing head 1 mounted thereon. The carriage 7 reciprocates in a direction substantially perpendicularly to the sheet transport direction (a second direction) to perform recording on the sheet. A unit in which ink tanks 6 for supplying inks to the printing head 1 are connected to the printing head 1 is positioned and held on the carriage 7. The carriage 7 has its upper portion positioned and guided by a carriage chassis 12. The carriage 7 also has its lower side positioned and guided by a carriage rail 13 positioned and fixed on the carriage chassis 12. The carriage 7 is driven through a timing belt 14 by a carriage motor 15 mounted on the carriage chassis 12. The sheet that has undergone recording in the printing section is discharged into a discharge section by the first discharge roller 4 and the second discharge roller 5, thereby completing the recording operation.

A construction for feed from a feed section placed in a bottom of the apparatus main body will next be described. Sheets stacked in a front feed cassette 36 are fed from a front place to an inner place in the apparatus main body by a front feed roller 34. The sheets are separated and fed one after another by means of a front feed separation guide 37 portion and guided by an outer U-turn guide 38 and an inner U-turn guide 39 to be transported to a nip between an intermediate roller 30 and an intermediate pinch roller 31. The sheet is further transported and guided by the sheet guide portions of the transport roller sheet guide 40, the sheet guide flapper 41 and the pinch roller holder 17 to be transported to the transport roller 3. Transport in the transport operation is thereafter performed in the same way as that in the operation for feed from the apparatus upper section.

Transport for both-side recording will next be described. A sheet which has undergone printing on its surface in the printing section is transported in the opposite direction by reversing the transport roller 3, the first discharge roller 4 and the second discharge roller 5 after the completion of recording on the surface. By being linked to this reversing operation, the sheet guide flapper 41 is upwardly turned and the sheet transported in the opposite direction is transported below the sheet guide flapper 41. The sheet is further transported, passed through the nip between the both-side transport roller 32 and a both-side pinch roller 33 and transported to the intermediate roller 30 and the intermediate pinch roller 31. Thereafter, the sheet is guided by the sheet guide portions of the transport roller sheet guide 40, the sheet guide flapper 41 and the pinch roller holder 17 to be transported to the transport roller 3 in the same way as that in the operation for front feed. The sheet is then transported into the printing section and recording is performed on the back surface, thus performing recording on the front and back surfaces.

A construction for drive of the transport roller 3, the first discharge roller 4 and the second discharge roller 5 will next be described. Drive is transmitted through a timing belt 19 from a transfer motor 20 to a transport gear 18 positioned and fixed on the transport roller 3. Subsequently, drive is transmitted through a discharge drive gear 26 to a first discharge gear 24 positioned and fixed on the first discharge roller 4. To the second discharge roller 5 placed on the platen 2, drive is transmitted through a discharge idler gear 25 placed on the platen 2.

A recovery unit 50 for maintaining ejection from the printing head with stability and a drive change unit 45 for changing drive to the feed, transport and recovery units will next be described. The recovery unit 50 is placed in a right front portion of the main body so as to face the printing head 1 in a standby position. The drive change unit 45 is placed in a right inner portion of the main body.

The relationship between the lengths of a feed roller 27, the both-side transport roller 32, the transport roller 3, the first discharge roller 4 and the second discharge roller 5 is as described below. That is, each of the feed roller 27 and the both-side transport roller 32 is shorter in roller length than each of the transport roller 3 and the discharge rollers.

Figure 5:
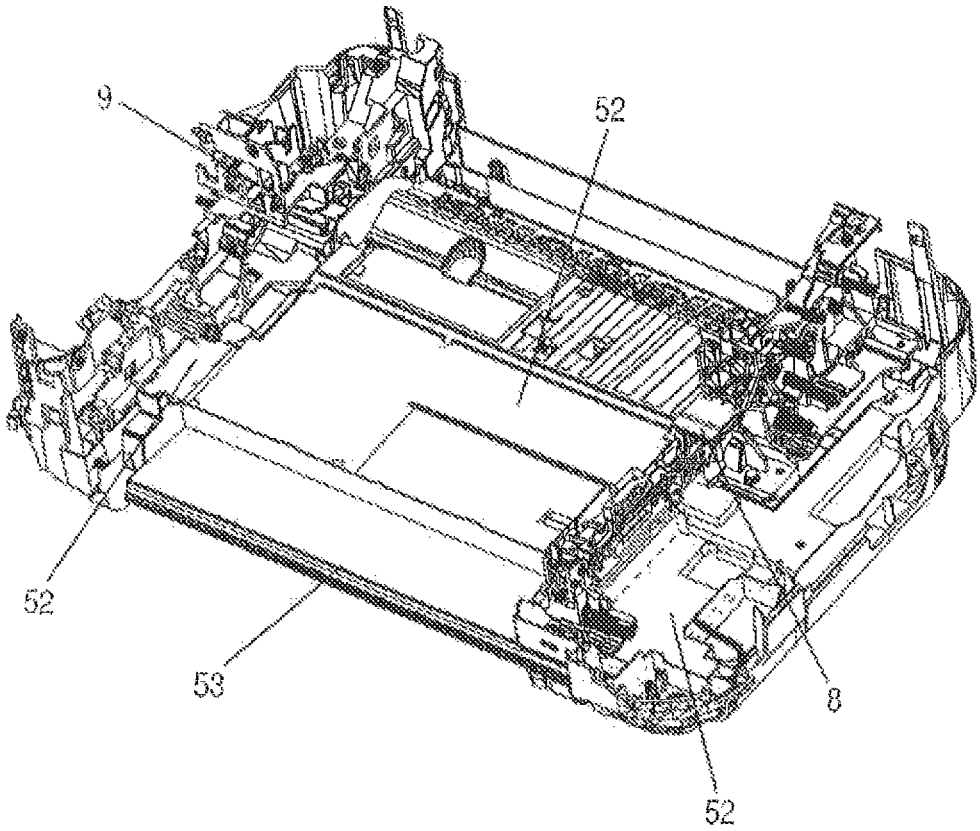
FIG. 5 is a perspective view of a base and side members.

Constructions specific to the first embodiment of the present invention will next be described. In FIG. 5, a right side member 8 and a left side member 9 are positioned relative to a base 53 placed at the bottom of the apparatus main body. The pair of the side members are disposed on opposite sides of the base with respect to the first direction. The right side member 8 and the left side member 9 are plate-like shape with different in shape from each other, and hold main units and members of the printer at left and right positions.

A waste ink absorbing member 52 for holding waste ink discharged from the recovery unit 50 is placed on a bottom portion of the base 53. The right side member 8 and the left side member 9 are positioned on a right side portion and a left side portion, respectively, of the base 53, and are fixed with a connecting members such as small screws. The right side member 8 and the left side member 9 placed on the two side portions of the base 53 are placed integrally from a front position to an inner position in the apparatus. The base 53 is a molded part formed by molding a resin material. The right side member 8 and the left side member 9 are also molded parts formed of a resin material. The rigidity of the resin material of the right side member 8 and the left side member 9 is set higher than the rigidity of the resin material of the base 53, thereby reducing a factor responsible for the influence of a factor in deformation of the base 53 on the right side member 8 and the left side member 9. It is important that the resin material of the right side member 8 and the left side member 9 have both a characteristic of having high mechanical strength and a characteristic of being not easily changed in size under the influence of temperature. A concrete example of the material forming the right side member 8 and the left side member 9 is a resin material obtained by adding glass fiber, carbon fiber or any other composite reinforcing material for improving the rigidity to a base resin material obtained by combining PPE (polyphenylene ether) and PS (polystyrene). The mechanical strengths of resin materials such as normal materials such as ABS (Acrylonitrile Butadiene Styrene), PS and POM (polyacetal) are 2000 to 3000 (MPa) in terms of bending elastic modulus. The resin material of the right side member 8 and the left side member 9 has a bending elastic modulus larger than that of these normal materials, i.e., a bending elastic modulus larger than 3000 (MPa), more preferably, larger than 7000 (MPa). Normal materials such as ABS, PS and POM have a linear expansion coefficient of 7 to 12 (E-5/K) as a characteristic of being not easily changed in size under the influence of temperature. The linear expansion coefficient of the resin material of the right side member 8 and the left side member 9 is set to a value smaller than that of these normal materials, i.e., a value smaller than 7 (E-5/K) (preferably, smaller than 3 (E-5/K)).

Figure 6:
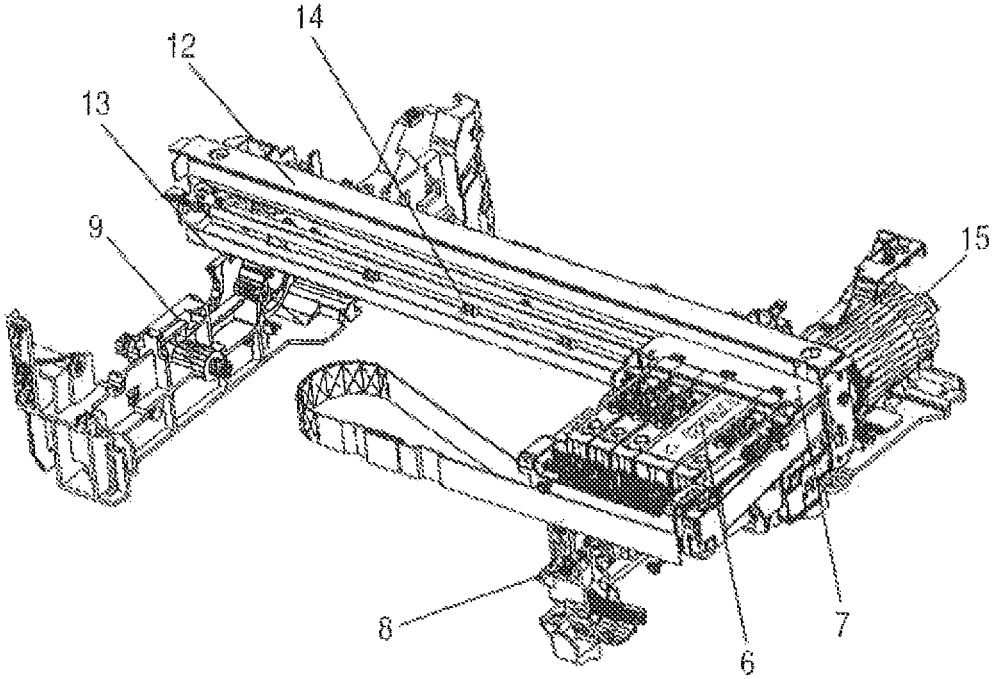
FIG. 6 is a perspective view of the side members and a carriage unit.
Figure 7:
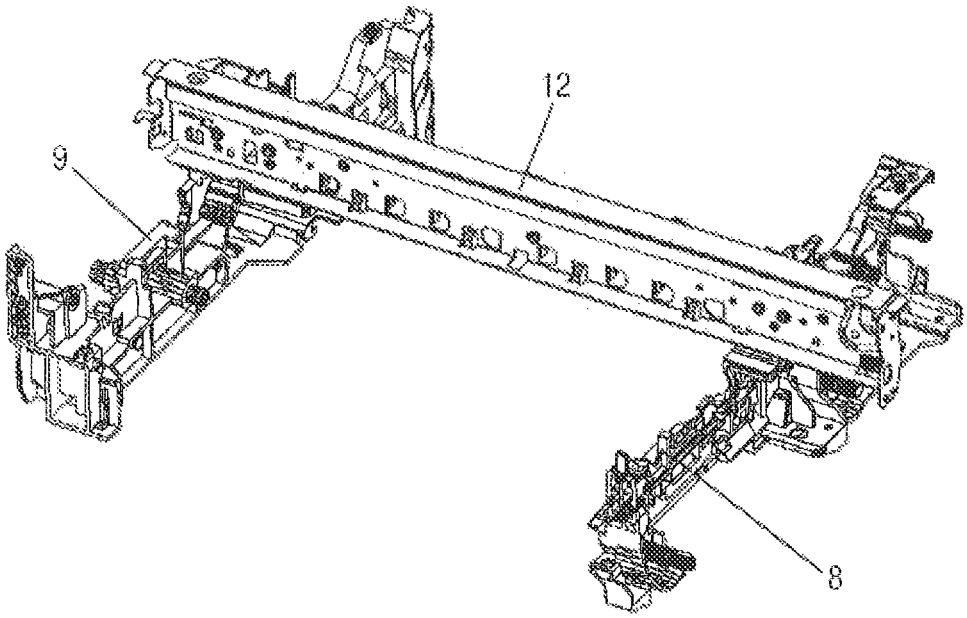
FIG. 7 is a front-side perspective view of the side members and a carriage chassis.
Figure 8:
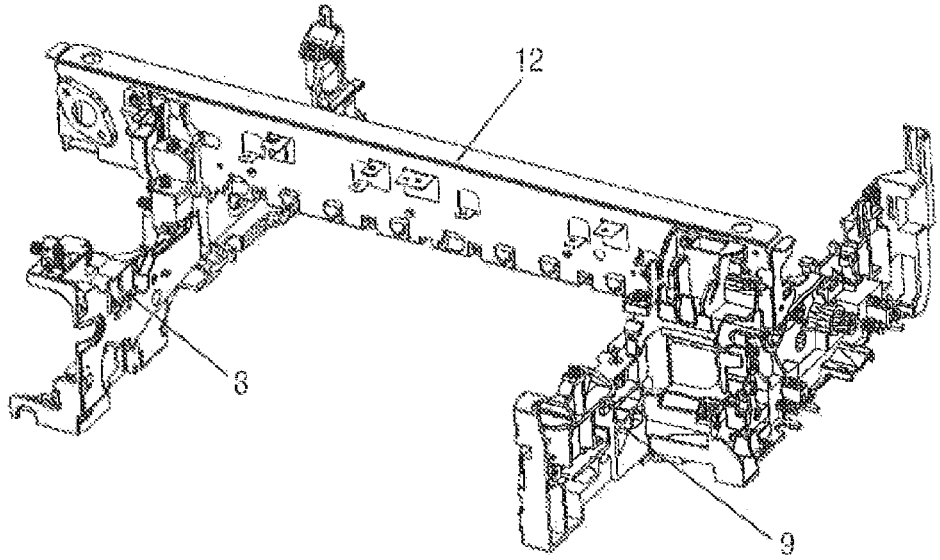
FIG. 8 is a front-side perspective view of the side members and the carriage chassis.

A construction in which the carriage chassis 12 is held on the right side member 8 and the left side member 9 will be described with reference to FIGS. 6, 7 and 8. FIG. 6 is a diagram illustrating a holding construction for the carriage unit held on the carriage chassis 12. FIGS. 7 and 8 are diagrams illustrating a holding construction of the carriage chassis 12. Referring to FIG. 6, the carriage chassis 12 holds the carriage motor 15, the timing belt 14 and the carriage rail 13 and further holds the carriage 7 on which the printing head 1 and the ink tanks 6 are positioned and held. The carriage chassis 12 is positioned and fixed with the right side member 8 and the left side member.

FIGS. 7 and 8 illustrate a positioning construction of the right side member 8, the left side member 9 and the carriage chassis 12. FIG. 7 is a front perspective view and FIG. 8 is a back perspective view. The carriage chassis 12 is positioned on the right side member 8 and the left side member 9 and are fixed with a connecting members such as small screws.

Figure 9:
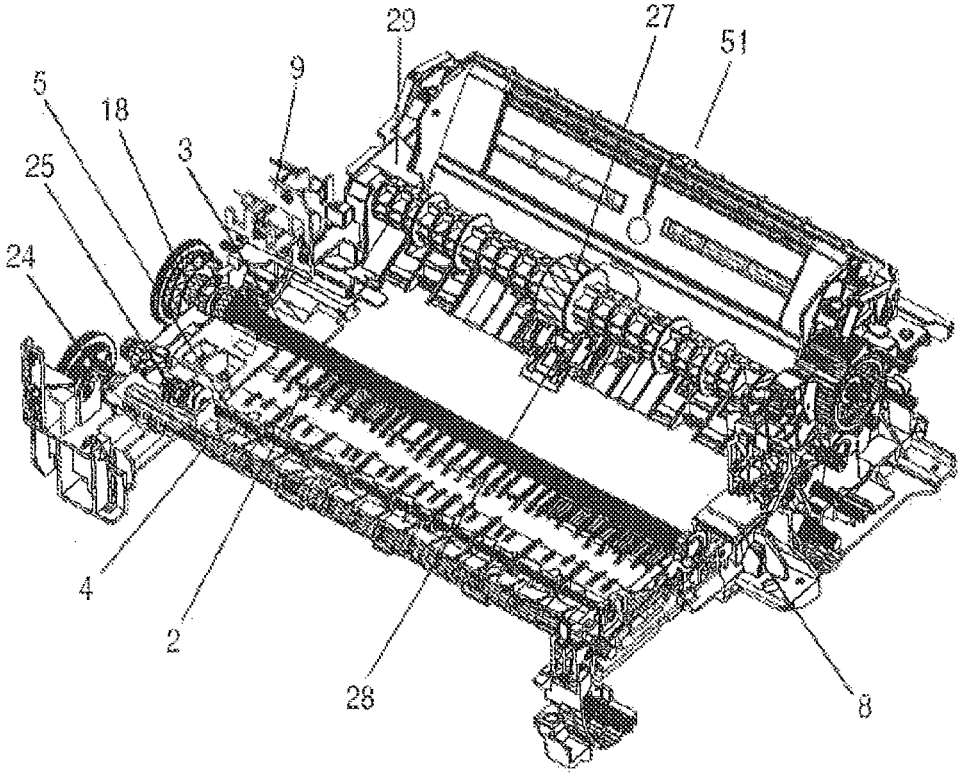
FIG. 9 is a perspective view of the side members, rollers, a platen and a feed unit.

FIG. 9 illustrates a construction in which the platen 2, the transport roller 3, the first discharge roller 4, the second discharge roller 5 and the feed unit 51 are held on the right side member 8 and the left side member 9. Two end portions of the platen 2 are positioned and fixed with the right side member 8 and the left side member 9. The platen 2 is a component part formed by molding a resin material. The rigidity of the resin material of the right side member 8 and the left side member 9 is set higher than the rigidity of the resin material of the platen 2. This is for the purpose of positioning and holding the platen 2 so that the sizes of the right side member 8 and the left side member 9 are not influenced by part shape factors such as a part tolerance, warp and bending of the platen 2 when the platen 2 is mounted on the right side member 8 and the left side member 9.

The shaft of the transport roller 3 is positioned and held on the right side member 8 and the left side member 9 by being brought into direct contact with the same or by means of bearing members. Similarly, the shaft of the first discharge roller 4 is positioned and held on the right side member 8 and the left side member 9 by being brought into direct contact with the same or by means of bearing members. While the construction in which the second discharge roller 5 is placed on the platen 2 has been described with respect to the first embodiment, a construction may alternatively be adopted in which the second discharge roller 5 has its shaft positioned and held on the right side member 8 and the left side member 9 by bringing the shaft into direct contact with the same or by means of bearing members, as does the first discharge roller 4.

Similarly, the feed unit 51 is positioned and fixed with the right side member 8 and the left side member 9 by means of a feed roller base 29 holding the feed roller 27 and the separating roller 28. The feed unit 51 is a unit including component parts having main portions formed by molding resin material. The rigidity of the resin material of the right side member 8 and the left side member 9 is set higher than the rigidity of the resin material of the feed unit 51. This is for the purpose of positioning and holding the feed unit 51 so that the sizes of the right side member 8 and the left side member 9 are not influenced by part shape factors such as a part tolerance, warp and bending of the feed unit 51 when the feed unit 51 is mounted on the right side member 8 and the left side member 9. Relatively positioning the units including the platen 2 and the feed unit 51 with accuracy to the right side member 8 and the left side member 9, is an important factor in ensuring high printing accuracy and high sheet transport accuracy.

While the construction in which the feed roller base 29 is positioned and fixed has been described with respect to the first embodiment, a construction may alternatively be adopted in which the feed roller 27 and the separating roller 28 are held on the right side member 8 and the left side member 9 directly or by means of bearings.

Figure 10:
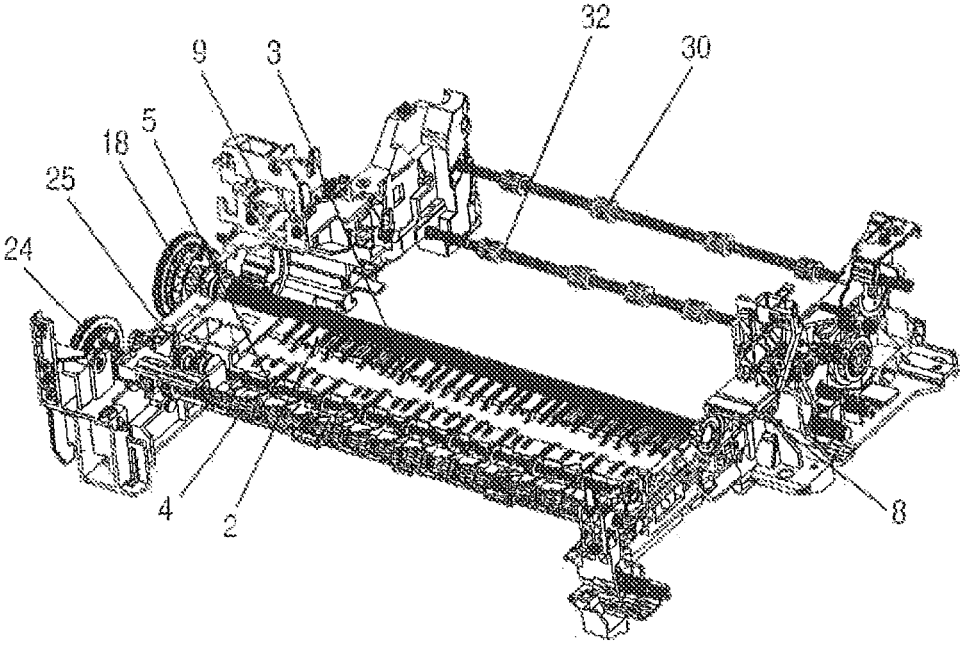
FIG. 10 is a perspective view of the side members and a feed transport roller in the first embodiment of the present invention, and also a perspective view of side members and a both-side transport roller in a second embodiment of the present invention.
Figure 11:
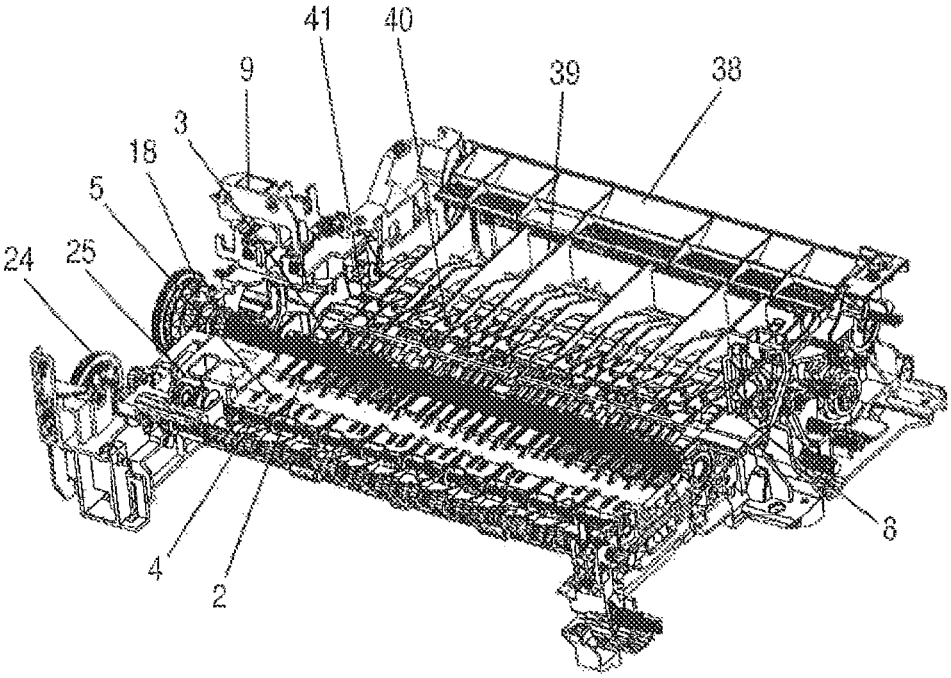
FIG. 11 is a perspective view of the side members and a sheet guide in the first embodiment of the present invention and also a perspective view of the side members and a sheet guide for both-side transport in the second embodiment of the present invention.

FIG. 10 illustrates a construction in which the intermediate roller 30 is held on the right side member 8 and the left side member 9. The shaft of the intermediate roller 30 is positioned and held with the right side member 8 and the left side member 9 by being brought into direct contact with the same or by means of bearing members, as is that of the transport roller 3. FIG. 11 illustrates a holding construction for the sheet guide members for guiding sheets in the transport direction. The transport roller sheet guide 40 and the sheet guide flapper 41 are positioned and held on the right side member 8 and the left side member 9.

As described above, among the units and component parts positioned and held on the right side member 8 and the left side member 9, the carriage chassis has the largest length and the other components are shorter than the carriage chassis with respect to the first direction. That is, the length of each of the feed roller 27, the both-side transport roller 32, the transport roller 3, the first discharge roller 4 and the second discharge roller is smaller than the length of the carriage chassis 12 with respect to the first direction. Also, the length of the platen 2 and the feed unit 51 are smaller than the length of the carriage chassis 12 with respect to the first direction.

While description has been made of a single-function printer, the printer according to the embodiment may be a multifunctional printer having scanner and FAX functions added in a printer upper section.

According to the present embodiment, as described above, constituent members relating to recording can be positioned and held on a common base side plate and, therefore, the constituent members can be positioned with high accuracy. As a result, high-accuracy recording construction can be realized. By placing the right side member 8 and the left side member 9 integrally from a front position to an inner position in the apparatus, a reduction in the number of side plate construction parts and simplification of the assembly process can be achieved.

By forming molded parts of a resin material as the right side member 8 and the left side member 9, advantages described below can be obtained. First, because the need to bend a material a number of times as in sheet metal is eliminated by adopting the right side member 8 and the left side member 9 formed of molded parts of a resin material, the component parts differing in width can be positioned with high accuracy. Also, the rollers in the sheet transport system in the printing section, including the transport roller 3, the first discharge roller 4 and the second discharge roller 5, and the carriage chassis 12 larger in transverse width than these rollers can be optimized in the widthwise direction. Thereby, the apparatus can be made compact in the widthwise direction in this way. Further, since the lengths of the rollers can be optimized to smaller values, factors in bending of the shafts of the rollers can be reduced and a high-accuracy transport construction can be realized at a low cost. Also, forming of a resin enables the portions to be held of the rollers, the portions to be held of the pinch rollers, the portions to be held of the sheet guide members and the like can be directly received by the right side member 8 and the left side member 9, thus realizing reductions in size and cost of the apparatus. Forming of a resin material also enables the frame of the printer to be constructed at a reduced cost in comparison with the sheet metal construction.

Second Embodiment

A second embodiment will be described with reference to FIGS. 10 and 11. The construction is such that a both-side recording construction is added to the first embodiment. The both-side transport roller 32 is positioned and held on the right side member 8 and the left side member 9 by being brought into direct contact with the same or by means of bearing members. The outer U-turn guide 38 and the inner U-turn guide 39 are also positioned and held on the right side member 8 and the left side member 9 in the same manner as the transport roller sheet guide 40 and the sheet guide flapper 41.

Third Embodiment

Figure 12:
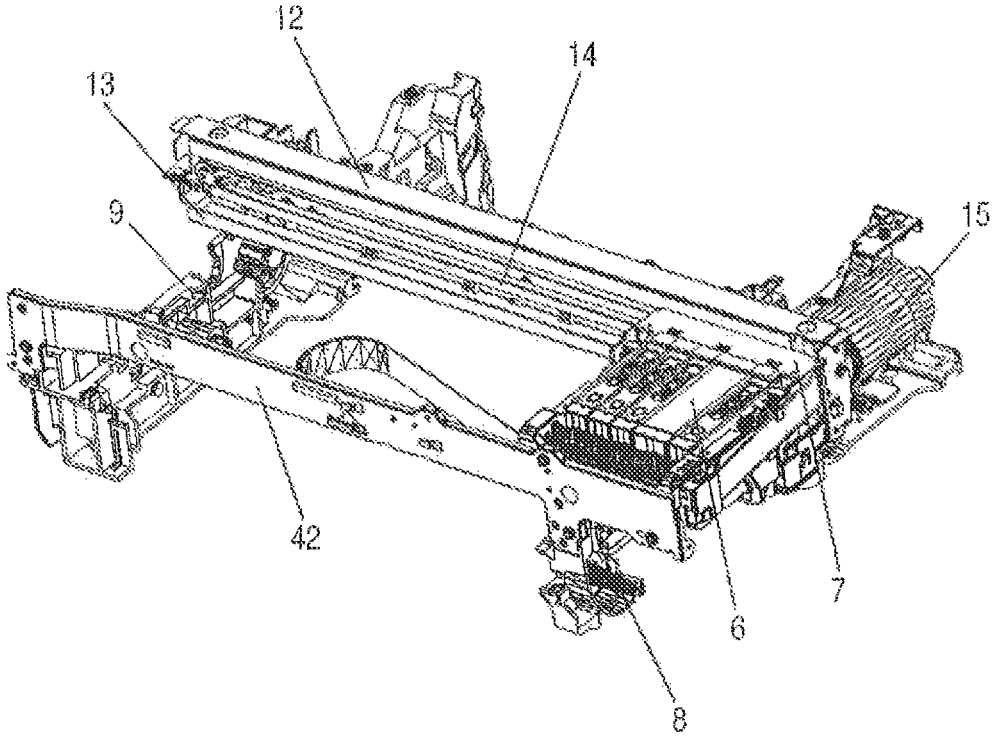
FIG. 12 is a perspective view of side members and a front chassis in a third embodiment of the present invention.

A third embodiment will be described with reference to FIG. 12. The construction is such that a front chassis 42 is added to the first embodiment. The front chassis 42 is positioned on the right side member 8 and the left side member 9 and is fixed with connecting members such as small screws, in the same manner as the carriage chassis 12.

Fourth Embodiment

Figure 13:
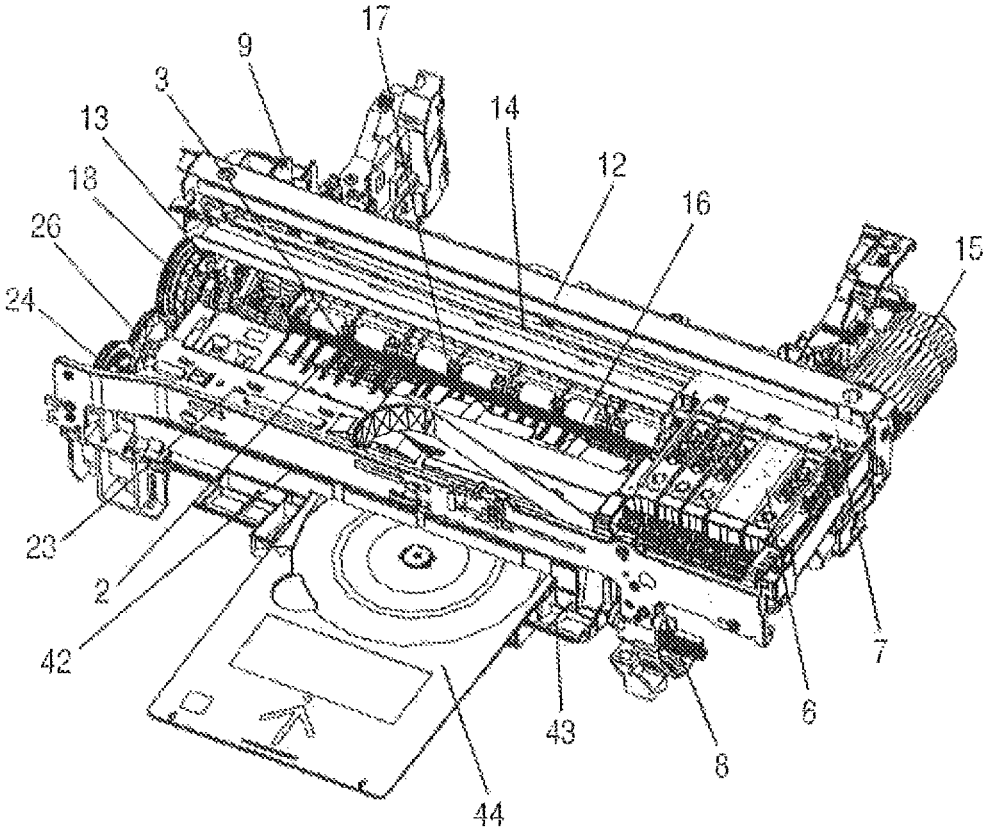
FIG. 13 is a perspective view of side members and a CD/DVD tray base in a fourth embodiment of the present invention.

A fourth embodiment will be described with reference to FIGS. 3 and 13. The construction is such that a function for recording on a CD (compact disk)/DVD (digital versatile disk) which is a sheet in disk form is added to the first embodiment.

As shown in FIG. 3, when CD/DVD recording is not used, a CD/DVD transport tray guide 43, which is a tray guide member for holding a sheet in disk form, is held in a closed state. As shown in FIG. 13, when CD/DVD recording is used, the CD/DVD transport tray guide 43 is in an opened state and a CD/DVD transport tray 44 is inserted from the front side of the apparatus to perform printing on a label on a CD/DVD. The CD/DVD transport tray guide 43 is positioned and held on the right side member 8 and the left side member 9 in the same manner as the sheet guide members and the platen 2.

Fifth Embodiment

A fifth embodiment will be described with reference to FIGS. 3 and 14. The construction is such that the pinch roller holder 17 and the pinch roller (spur) holder 23 are positioned on the right side member 8 and the left side member 9. The pinch roller holder 17 has the transport roller pinch roller 16. The pinch roller (spur) holder 23 has the first discharge roller pinch roller (spurs) 21 and the second discharge roller pinch roller (spurs) 22.

In the first embodiment, as shown in FIG. 3, the pinch roller holder 17 having the transport roller pinch roller 16 is supported on the carriage chassis 12. The pinch roller (spur) holder 23 has a mechanism for moving away from the first discharge roller 4 and the second discharge roller 5 by being linked to the opening/closing operation of the CD/DVD transport tray guide 43 at the time of CD/DVD printing. This pinch roller (spur) holder 23 is positioned and held on the platen 2.

Figure 14:
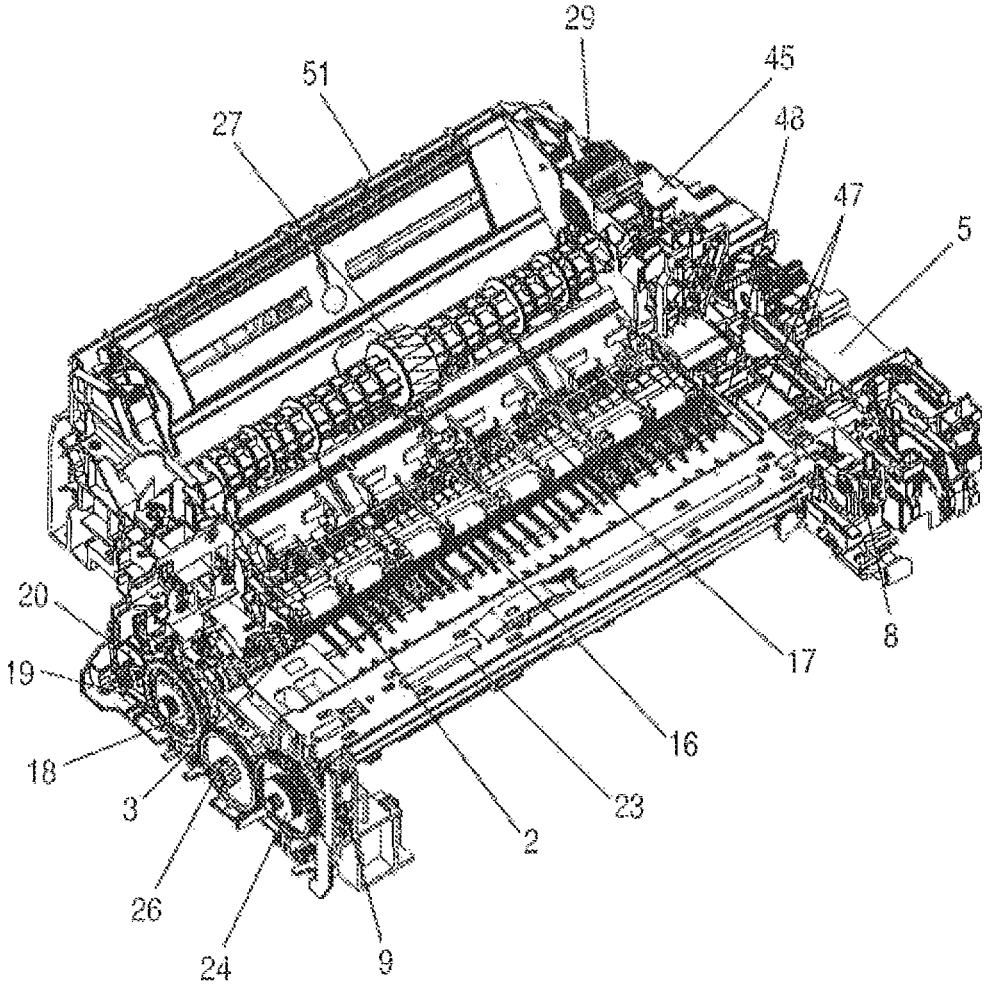
FIG. 14 is a perspective view of side members, a transport roller pinch roller and a discharge roller pinch roller (spurs) in a fifth embodiment of the present invention.

The construction may alternatively be such that, as shown in FIG. 14, the pinch roller holder 17 and the pinch roller (spur) holder 23 are positioned and held on the right side member 8 and the left side member 9, as are the sheet guide members and the rollers.

Sixth Embodiment

Figure 15:
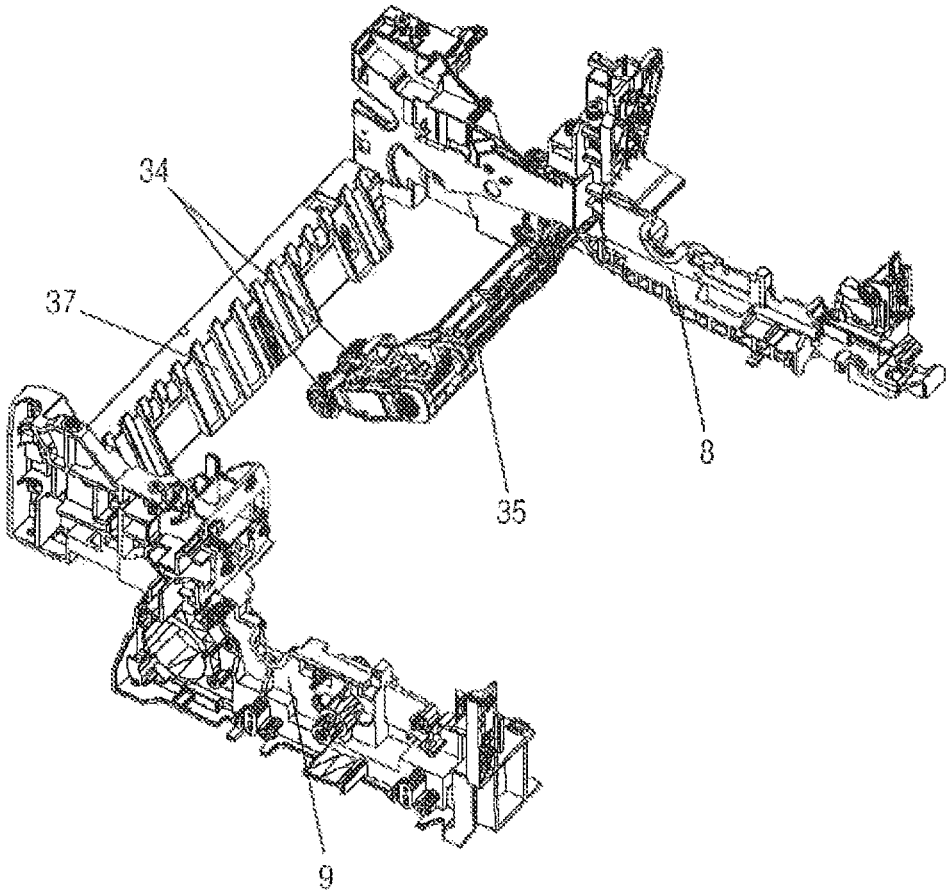
FIG. 15 is a perspective view of side members, a front feed roller and a separation sheet guide in a sixth embodiment of the present invention.

A sixth embodiment will be described with reference to FIG. 15. The construction is such that a front feed roller unit 35 and the front feed separation guide 37 for front feed are held on the right side member 8 and the left side member 9. The front feed separation guide 37 is positioned and held on the right side member 8 and the left side member 9, in the same way as the sheet guide members. The front feed roller unit 35 having front feed roller 34 is positioned and held on the right side member 8.

Seventh Embodiment

Figure 16:
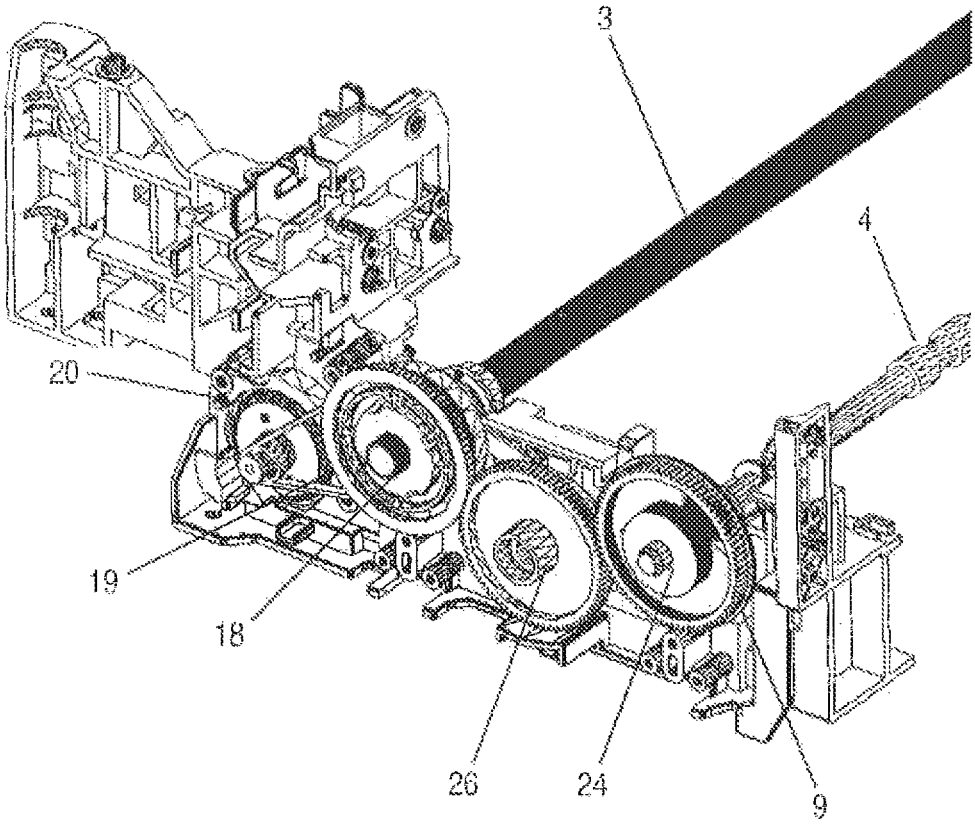
FIG. 16 is a perspective view of left side member, a transport drive system and a drive source in a seventh embodiment of the present invention.

A seventh embodiment will be described with reference to FIG. 16. The construction is such that a transport drive system and a drive source are held on the left side member 9. The discharge drive gear 26 and the transport motor 20 are positioned and held on the left side member 9. That is, the drive source and a drive transmission section for transmitting a drive force from the drive source to a member to be driven are positioned and held on the left side member 9. A drive change mechanism section for selecting an object to be driven by the drive source from a plurality of sections to be driven, i.e., the drive change unit 45, may be positioned and held on the left side member 9. While the construction for positioning and holding on the left side member 9 has been described with reference to FIG. 16, a construction may alternatively adopted in which the transport drive system and the drive source are placed on the right-hand side and positioned and held on the right side member 8.

Eighth Embodiment

Figure 17:
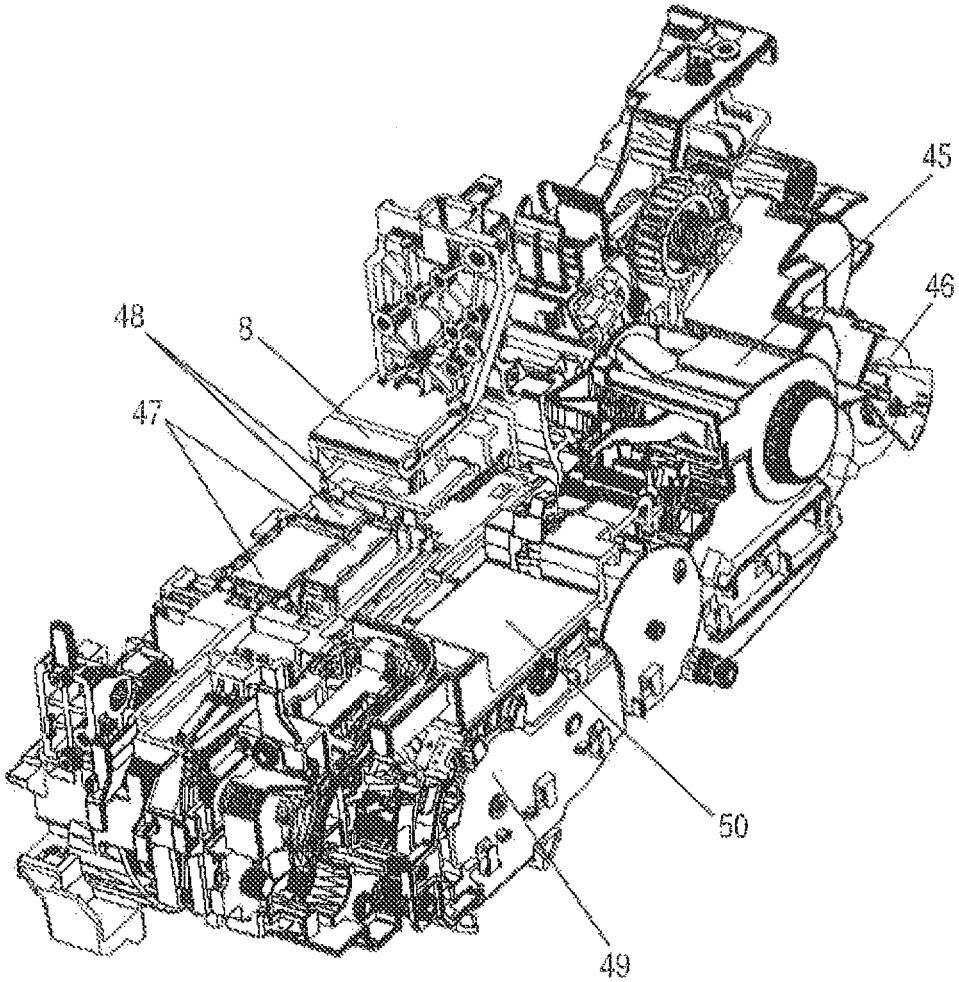
FIG. 17 is a perspective view of right side member, a recovery unit, a drive selection mechanism and a drive source in an eighth embodiment of the present invention.

An eighth embodiment will be described with reference to FIG. 17. The construction is such that the recovery unit 50, the drive change unit 45 and a feed/recovery system transport motor 46 are held on the base right-side plate 8. The recovery unit 50 has a cap 47 for capping the printing head 1, a wiper 48 for cleaning a nozzle portion of the printing head 1, a drawing pump 49 for performing drawing recovery of the printing head 1, etc. The recovery unit 50, the drive change unit 45 and the feed/recovery system transport motor 46 are positioned and held on the base right-side plate 8.

While the construction for positioning and holding on the right side member 8 has been described with reference to FIG. 17, a construction may alternatively adopted in which the recovery unit 50, the drive change unit 45, the feed/recovery system transport motor 46, etc. are placed on the left-hand side and positioned and held on the left side member 9.

Ninth Embodiment

Figure 18:
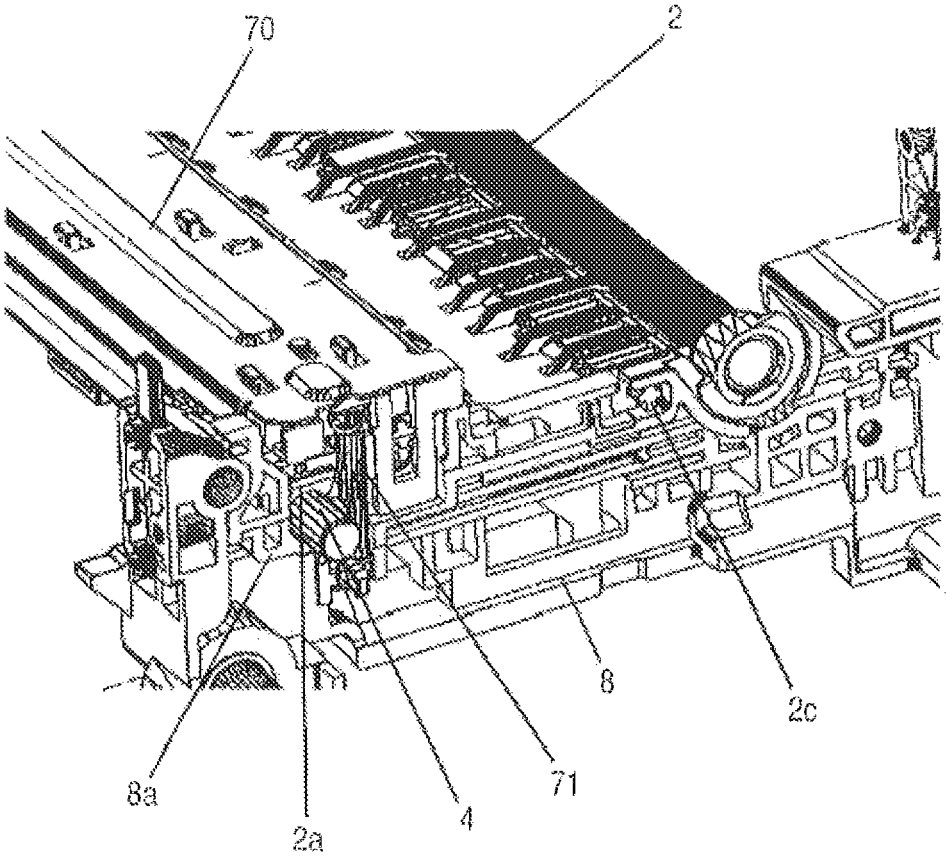
FIG. 18 is a perspective view of a right side member, a platen and a spur base unit in a ninth embodiment.
Figure 19:
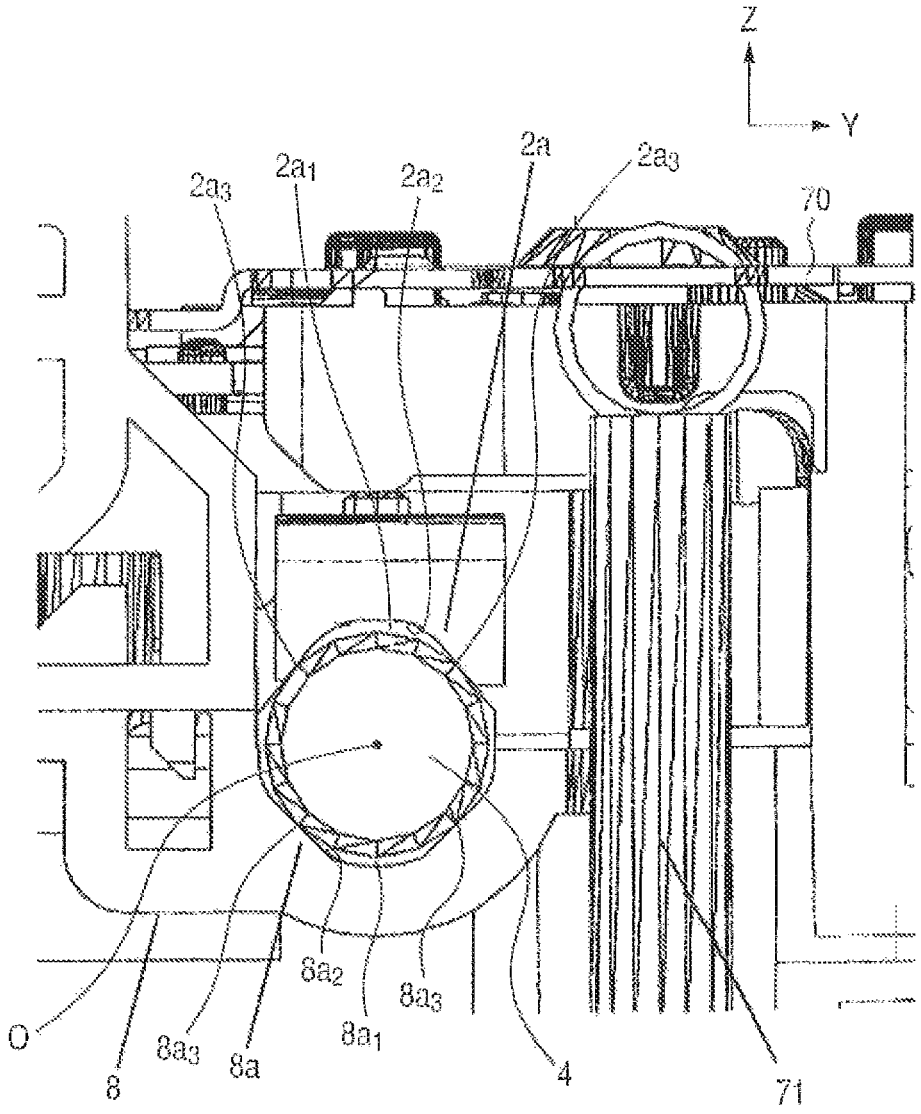
FIG. 19 is a side view of the right side member, the platen and the spur base unit.
Figure 20:
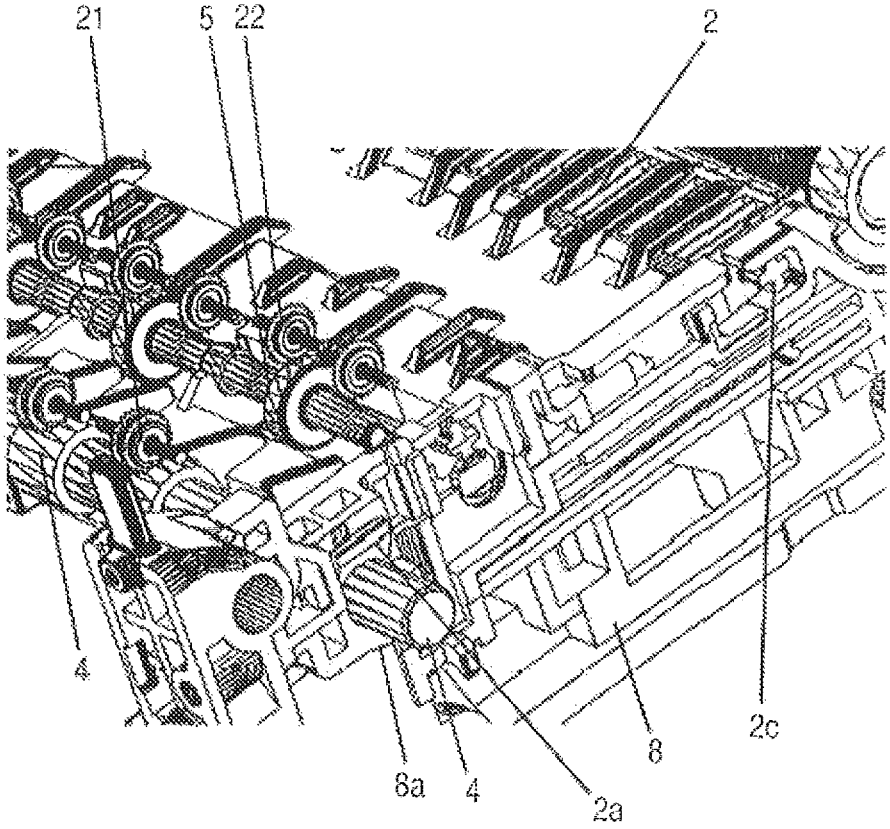
FIG. 20 is a perspective view of the right side member, the platen and a discharge roller.
Figure 21:
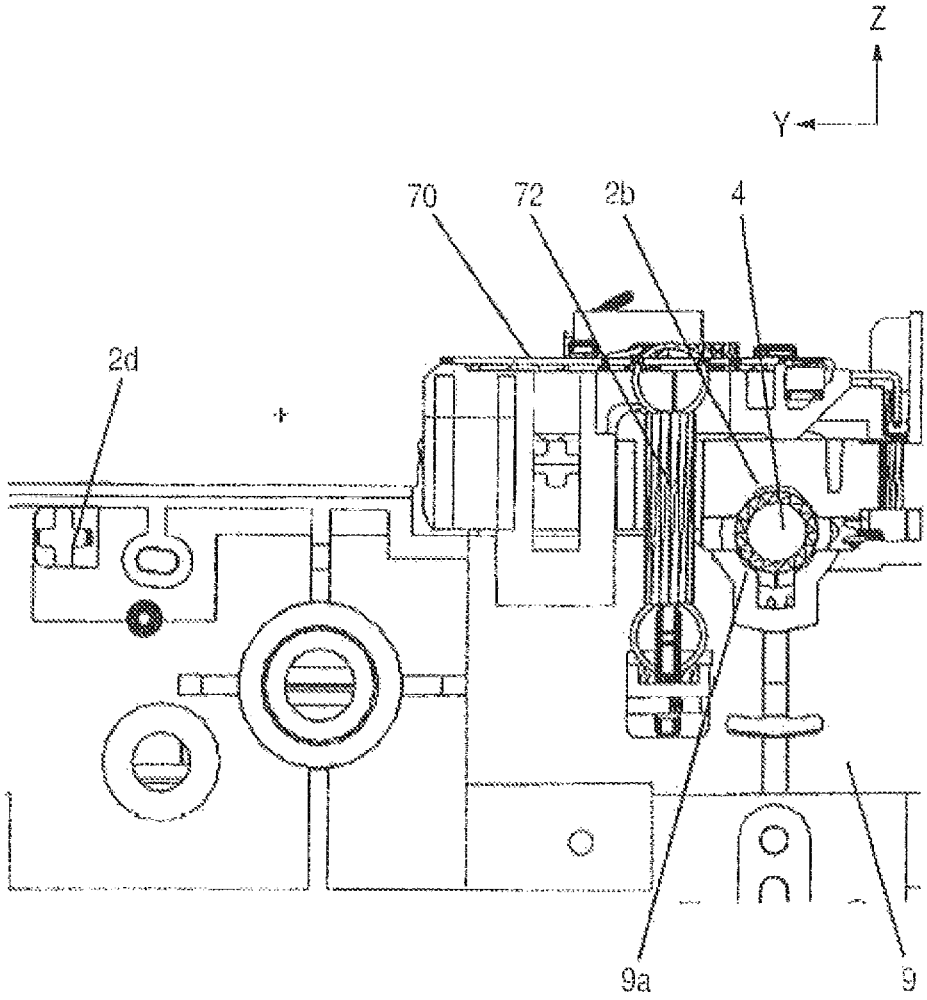
FIG. 21 is a side view of a left side member, the platen and the spur base unit.
Figure 22:
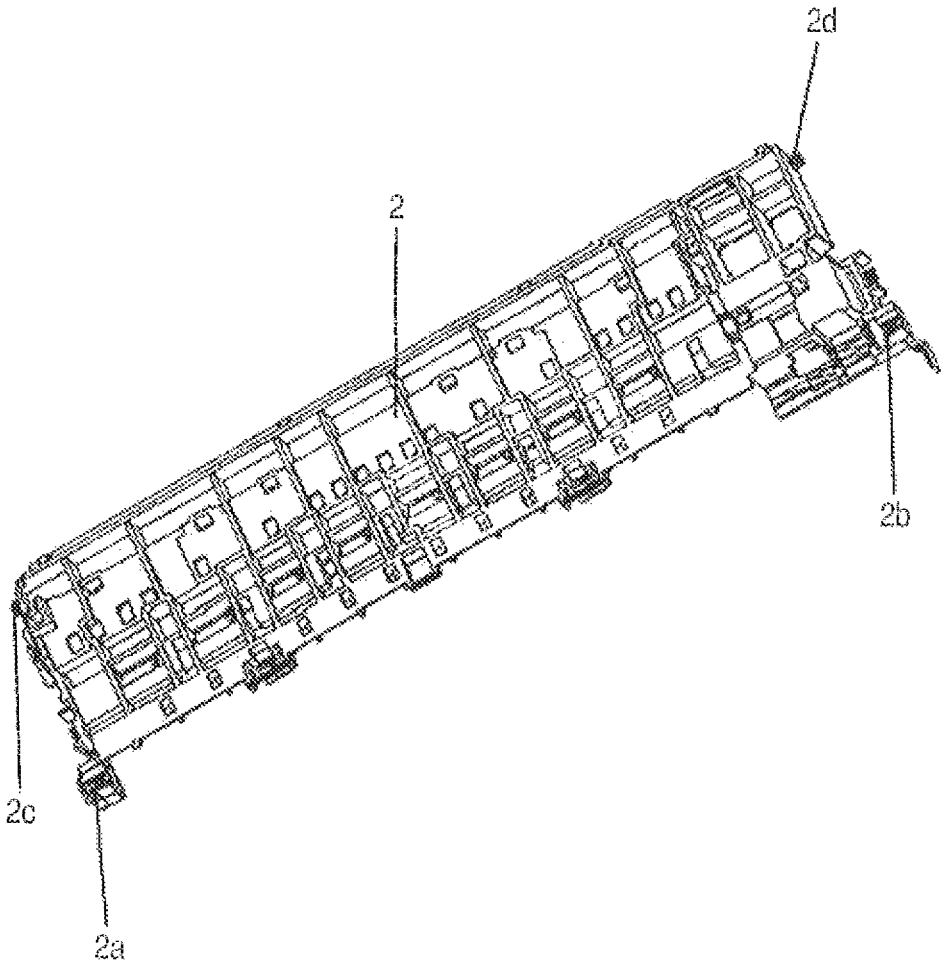
FIG. 22 is a perspective view of the back side of the platen.
Figure 23:
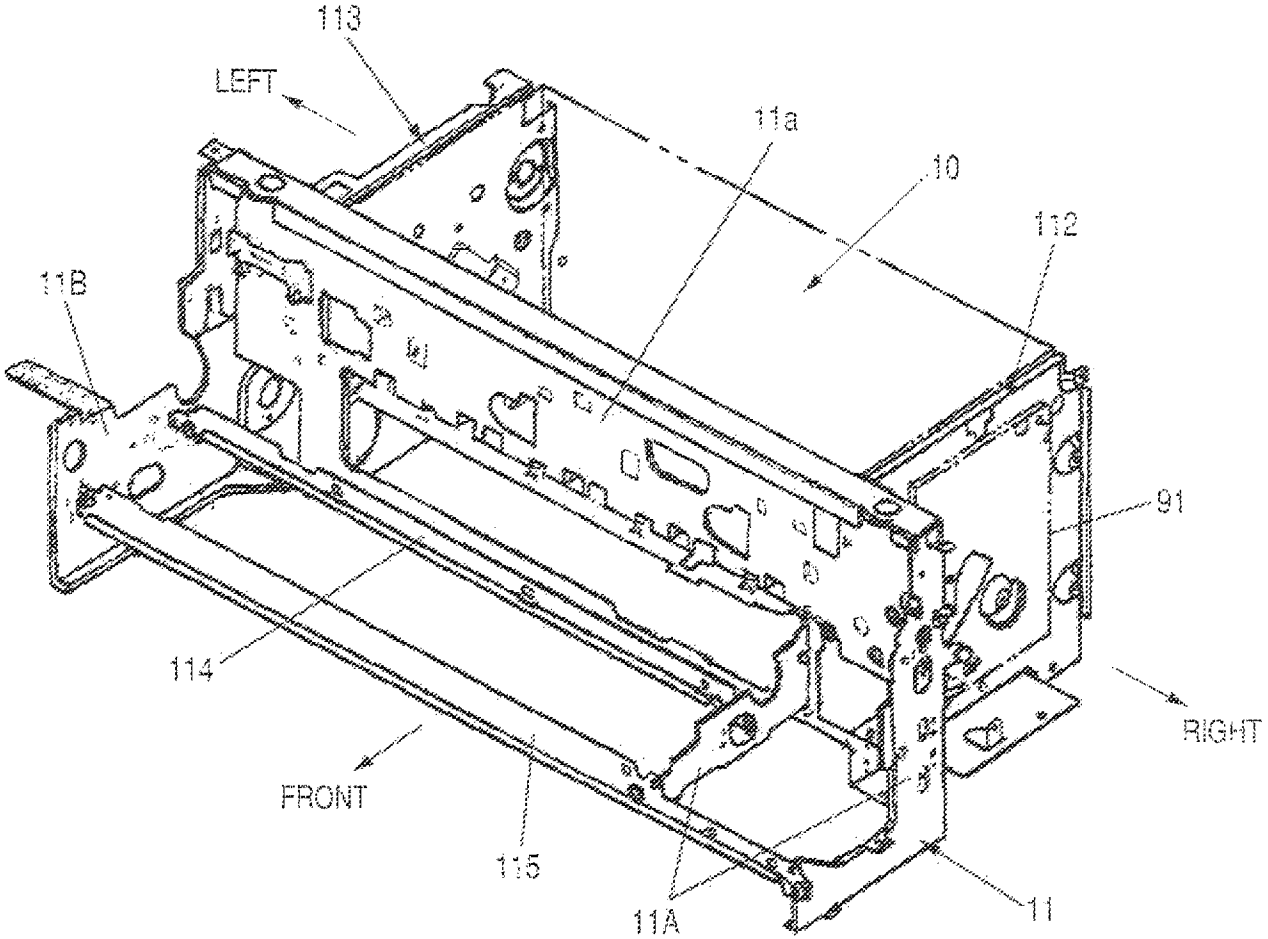
FIG. 23 PRIOR ART
FIG. 23 is a perspective view of a main body chassis construction in an example of a conventional printer.

Positioning of the discharge roller and the platen 2 in a ninth embodiment will be described with reference to FIGS. 18, 19, 20, 21 and 22. FIG. 18 is a perspective view of the right side member 8, the platen 2 and a spur base unit 70. FIG. 19 is an enlarged side view of portions of the right side member 8, the platen 2 and the spur base unit 70. FIG. 20 is a perspective view of the right side member 8, the platen 2 and the first discharge roller 4. FIG. 21 is an enlarged side view of portions of the left side member 9, the platen 2 and the spur base unit 70. FIG. 22 is a perspective view of the back side of the platen 2.

The printer in the present embodiment has two discharge rollers: the first discharge roller 4 and the second discharge roller 5. The discharge roller positioned with a positioning portion 2*a* on the downstream right-hand side and a positioning portion 2*b* on the downstream left-hand side is the main discharge roller receiving a higher spur pressure, i.e., the first discharge roller 4. In the following description, "upward" or "above" designates a direction in which the platen 2 is seen from the right side member 8 and left side member 9 side, and "downward" or "below" designates a direction opposite to the direction designated by "upward" of "above", i.e., a direction in which the right side member 8 and the left side member 9 are seen from the platen 2 side.

The first discharge roller 4 has its shaft portions positioned with a positioning portion 8*a* of the right side member 8 and a positioning portion 9*a* of the left side member 9, which are second positioning portions. The positioning portions 8*a* and 9*a* have generally V-shaped profiles.

Positioning of the first discharge roller 4 with the positioning portion 8*a* will be described in more detail with reference to FIG. 19. The positioning portion 8*a* has a generally V-shaped profile such that a recess 8*a*1 is, which is a second recessed portion, is formed therein. The positioning portion 8*a* is opened upward. While the recess 8*a*1 shown in FIG. 19 is seen as the shape of U as a whole, wall surfaces of an inner wall 8*a*2 in which two contact points 8*a*3 are positioned have planar shapes. The two contact points 8*a*3 are respectively positioned on the upstream side and on the downstream side of an axial center O of the first discharge roller 4 in the Y-direction, and are each positioned below the axial center O in the Z-direction.

When the shaft portion of the first discharge roller 4 is placed on the recess 8*a*1 of the positioning portion 8*a* having the above-described construction, the two contact points 8*a*3 in the inner wall 8*a*2 of the recess 8*a*1 are brought into contact with an outer peripheral surface of the shaft portion. That is, the first discharge roller 4 is not fitted in the recess 8*a*1 but supported by two points (two contact points 8*a*3), thereby positioning the first discharge roller 4 in the Y-direction and in the Z-direction. The first discharge roller 4 is also positioned in the same manner with the positioning portion 9*a* having the same structure as that of the positioning portion 8*a*. That is, the first discharge roller 4 is positioned on the right side member 8 and the left side member 9. The wall surfaces of the inner wall 8*a*2 in which the contact points 8*a*3 are positioned are not limited to the flat surfaces. The wall surfaces may be curved surfaces if they are capable of supporting the first discharge roller 4 not by surfaces but by two points.

The platen 2 has the positioning portion 2*a* and the positioning portion 2*b*, which are first positioning portions, at positions corresponding to the positioning portion 8*a* and the positioning portion 9*a*. The platen 2 is positioned on the first discharge roller 4. The positioning portion 2*a* and the positioning portion 2*b* also have generally V-shaped profiles but are opened downward, conversely to the positioning portions 8*a* and the positioning portion 9*a*.

Positioning of the platen 2 on the first discharge roller 4 will be described in more detail with reference to FIG. 19. The positioning portion 2*a* has a generally V-shaped profile such that a recess 2*a*1, which is a first recessed portion, is formed therein. The positioning portion 2*a* is opened downward. While the recess 2*a*1 shown in FIG. 19 is seen as the shape of U as a whole, wall surfaces of an inner wall 2*a*2 in which two contact points 2*a*3 are positioned have planar shapes. The two contact points 2*a*3 are respectively positioned on the upstream side and on the downstream side of the axial center O of the first discharge roller 4 in the Y-direction and are each positioned above the axial center O in the Z-direction.

When the recess 2*a*1 of the positioning portion 2*a* having the above-described construction is placed on the shaft portion of the first discharge roller 4, the two contact points 2*a*3 in the inner wall 2*a*2 of the recess 2*a*1 are brought into contact with an outer peripheral surface of the shaft portion. That is, the first discharge roller 4 supports the positioning portion 2*a* not by being fitted in the recess 2*a*1 but by two points (two contact points 2*a*3), thereby positioning the positioning portion 2*a* on the first discharge roller 4 in the Y-direction and in the Z-direction. The positioning portion 2*b* having the same structure as that of the positioning portion 2*a* is also positioned on the first discharge roller 4 in the same manner. The wall surfaces of the inner wall 2*a*2 in which the contact points 2*a*3 are positioned are not limited to the flat surfaces. The wall surfaces may be curved surfaces if they are capable of supporting the first discharge roller 4 by two points.

Thus, the first discharge roller 4 is pinched at its right side between the positioning portion 8*a* and the positioning portion 2*a* and at its left side between the positioning portion 9*a* and the positioning portion 2*b*. The platen 2 is positioned on the first discharge roller 4, while the first discharge roller 4 is positioned on the right side member 8 and the left side member 9. That is, the platen 2 is positioned on the right side member 8 and the left side member 9 through the first discharge roller 4.

A mechanism for preventing play of the first discharge roller 4 and the platen 2 will next be described. Spur base springs 71, 72, which are a first urging unit, are hooked between a spur base unit 70 for supporting spurs 21 and 22 placed above the platen 2 and the right side member 8 and the left side member 9. By the urging forces of the spur base springs 71 and 72, the first discharge roller 4 and the platen 2 are pressed against the right side member 8 and the left side member 9. That is, the first discharge roller 4 is pinched from above and below between the positioning portion 8*a* and the positioning portion 2*a* and between the positioning portion 9*a* and the positioning portion 2*b*, while pressing forces are being applied thereto. Since the positioning portions 8*a*, 2*a*, 9*a* and 2*b* are each generally V-shaped, they press the first discharge roller 4 in oblique directions. As a result, the first discharge roller 4 is positioned without play in Y- and Z-directions.

As shown in FIGS. 19 and 20, the spur base springs 71 and 72 are placed in the vicinities of the positioning portion 2*a* and the positioning portion 2*b*. Therefore, pressing forces are applied on the shaft of the first discharge roller 4. As a result, creep in the platen due to change with time is extremely small. It is preferable that the spur base springs 71 and 72 be placed right above the positioning portions 2*a* and 2*b*. V-shaped portions may also be provided in the spur base unit 70 as well as in the positioning portions 8*a*, 2*a*, 9*a*, and 2*b* to perform positioning of the first discharge roller 4 or the platen 2.

The platen 2 has positioning bosses 2*c* and 2*d* at left and right positions in its upstream portion. These bosses 2*c* and 2*d* are brought into contact with the right side member 8 and the left side member 9 from above to position the platen 2. This positioning will be described below. The second follower roller (spurs) 22 is urged against the second discharge roller 5 mounted on the platen 2, with spring pressure applied to the second follower roller 5. Spring pressures, applied by means of the spurs 22, which are second a urging unit, are applied upstream of the first discharge roller 4, so that a downward moment is produced at each of the bosses 2*c* and 2*d* as a turning moment about the first discharge roller 4 as a center of ratation. By this moment, the bosses 2*c* and 2*d* are pressed downward to be brought into contact with the right side member 8 and the left side member 9, thus positioning the platen without play.

By the above-described construction of the present embodiment, advantages described below can be obtained. The first discharge roller 4 and the platen 2 can be positioned on the right side member 8 and the left side member 9 without play. Fluctuations of the first discharge roller 4 and the platen 2 during sheet transport are thereby made extremely small. Therefore, variation in the back tension produced in the sheet can be reduced to maintain good paper feed accuracy. Further, the accuracy is improved with respect to the amounts of variation in height of the first discharge roller 4 and the platen 2 in comparison with the conventional fitting positioning. Therefore, variation in height of the sheet leading end when the sheet leading end runs onto the nip line between the first discharge roller 4 and spurs 21 is reduced. As a result, good paper feed accuracy can be maintained. Thus, an ink jet printer having improved image quality is realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2008-122402, filed May 8, 2008, 2008-215278, filed Aug. 25, 2008, and 2009-082230, filed Mar. 30, 2009, which are hereby incorporated by reference in their entirety.

The invention claimed is:

1. A printing apparatus, comprising:

a base provided at a bottom of the apparatus;

a first side member and a second side member, each provided as a part different from the base, and disposed on opposite sides of the base with respect to a first direction;

at least one roller for transporting a sheet in a second direction intersecting the first direction;

a print unit having a printing head; and a platen which supports the sheet on which recording is performed with the printing head, wherein the at least one roller, the print unit, and the platen are held with the first side member and the second side member, and wherein the first side member and the second side member are formed by a molded first resin material and the base is formed by a molded second resin material, and a bending elastic modulus of the first resin material is larger than a bending elastic modulus of the second resin material.

2. The apparatus according to claim 1, wherein the first resin material is a resin material obtained by adding glass fiber, carbon fiber or a composite reinforcing material to a base resin material obtained by combining PPE and PS.

3. The apparatus according to claim 2, wherein the first resin material has a bending elastic modulus larger than 3000 (MPa) and a linear expansion coefficient smaller than 7 (E-5/K).

4. The apparatus according to claim 2, wherein the first resin material has a bending elastic modulus larger than 7000 (MPa) and a linear expansion coefficient smaller than 3 (E-5/K).

5. The apparatus according to claim 1, wherein the platen is formed by a molded third resin material, and a bending elastic modulus of the first resin material is larger than that of the third resin material.

6. The apparatus according to claim 1, further comprising a feed unit which separates and feeds sheets one by one in the second direction, wherein the feed unit has its main portions formed by a molded third resin material, and a bending elastic modulus of the first resin material is larger than a bending elastic modulus of the third resin material.

7. The apparatus according to claim 1, further comprising a drive source and a transmission section for transmitting a drive force from the drive source to a section to be driven, the drive source and the transmission section being held with one of the first side member and the second side member.

8. The apparatus according to claim 1, further comprising a recovery unit for maintaining the printing head as an inkjet head, wherein the recovery unit is held with one of the first side member and the second side member.

9. A printing apparatus, comprising:

a base provided at a bottom of the apparatus;

a first side member and a second side member each provided as a part different from the base and being integrated with the base;

at least one roller for transporting a sheet; and a print unit for printing an image on the sheet, wherein the at least one roller and the print unit are held with the first side member and the second side member, and wherein the first side member and the second side member are formed by a molded first resin material and the base is formed by a molded second resin material, and a bending elastic modulus of the first resin material is larger than a bending elastic modulus of the second resin material.

10. The apparatus according to claim 9, wherein the first resin material has a bending elastic modulus larger than 7000 (MPa) and a linear expansion coefficient smaller than 3 (E-5/K), and the second resin material has a bending elastic modulus smaller than 3000 (MPa) and a linear expansion coefficient lager than 7 (E-5/K).

11. The apparatus according to claim 10, wherein the first resin material is a resin material obtained by adding glass fiber, carbon fiber or a composite reinforcing material to a base resin material obtained by combining PPE and PS.

12. The apparatus according to claim 9, wherein the print unit includes an inkjet printing head.

* * * * *